US008337041B2

(12) United States Patent
McCane et al.

(10) Patent No.: US 8,337,041 B2
(45) Date of Patent: Dec. 25, 2012

(54) SURFACE MOUNTED LIGHTING FIXTURE

(75) Inventors: Stephen Barry McCane, McDonough, GA (US); Stephen Haight Lydecker, Snellville, GA (US); John T. Mayfield, III, Loganville, GA (US); Russell Vern Rouse, Oxford, GA (US)

(73) Assignee: ABL IP Holding LLC, Conyers, GA (US)

( * ) Notice: Subject to any disclaimer, the term of this patent is extended or adjusted under 35 U.S.C. 154(b) by 306 days.

(21) Appl. No.: 12/635,123

(22) Filed: Dec. 10, 2009

(65) Prior Publication Data

US 2010/0149791 A1 Jun. 17, 2010

Related U.S. Application Data

(60) Provisional application No. 61/201,530, filed on Dec. 11, 2008.

(51) Int. Cl.
*F21V 21/00* (2006.01)
*F21V 1/00* (2006.01)
*F21V 5/00* (2006.01)

(52) U.S. Cl. ..... 362/217.04; 362/147; 362/217.02

(58) Field of Classification Search ..... 362/217.01, 362/219, 225, 217.03, 217.04, 217.06, 217.07, 362/217.08, 217.09, 217.1, 217.11, 217.12, 362/217.14, 217.15, 227, 238, 240, 241, 362/257, 290, 291, 145, 147, 148, 150
See application file for complete search history.

(56) References Cited

U.S. PATENT DOCUMENTS 2,591,661 A * 4/1952 McCandless ..... 362/217.05
2,710,336 A * 6/1955 Jorn ..... 362/368
2,924,436 A * 2/1960 Baran ..... 165/56
2,926,237 A * 2/1960 Sorenson ..... 362/150
3,045,577 A * 7/1962 Lazerson ..... 454/293
4,138,716 A 2/1979 Muhlethaler et al.
4,338,653 A 7/1982 Marrero
4,356,540 A 10/1982 Goralnik
4,928,209 A * 5/1990 Rodin ..... 362/221
4,976,633 A 12/1990 Beghelli
4,980,808 A 12/1990 Lilos
5,020,296 A 6/1991 Aoshika
5,426,572 A 6/1995 Weinstock et al.
5,653,412 A 8/1997 Martorano et al.
5,727,871 A 3/1998 Kotloff
5,823,663 A 10/1998 Bell et al.
5,988,829 A * 11/1999 Holder ..... 362/223
(Continued)

*Primary Examiner* — Danielle Allen
(74) *Attorney, Agent, or Firm* — Kilpatrick Townsend & Stockton LLP

(57) ABSTRACT

Surface mounted lighting fixtures having a troffer channel and a frame that extends around the troffer channel. The troffer channel includes a top wall and side walls. To impart a "back" to the fixture, the troffer channel is positioned in the frame so that the upper surface of the lighting fixture is defined by the top wall of the troffer channel and so that the fixture is mounted to a ceiling via the top wall of the troffer channel. The side walls of the troffer channel are preferably angled relative to the top wall to reflect light out of the fixture as desired. Tie brackets, lamp holder brackets, electrical components, and traditional louvers and lensed door components may be supported by the lighting fixture. An installation bracket may be provided to facilitate installation of the lighting fixture. Such brackets may be mounted to the ceiling and used to suspend the fixture to allow the installer to perform the necessary wiring and other preparation work prior to securing the fixture directly to the ceiling via the troffer channel.

15 Claims, 20 Drawing Sheets

U.S. PATENT DOCUMENTS

| | | | | |
|---|---|---|---|---|
| 5,988,836 | A | 11/1999 | Swarens | |
| 6,231,213 | B1 | 5/2001 | Schmidt et al. | |
| 6,530,681 | B2 | 3/2003 | Sieczkowski | |
| D490,559 | S | 5/2004 | Small | |
| 6,824,298 | B2 | 11/2004 | Childs | |
| 6,991,352 | B2 | 1/2006 | Garber et al. | |
| 7,014,332 | B2 | 3/2006 | Sergio et al. | |
| 7,192,158 | B2 | 3/2007 | Eppler | |
| 7,287,883 | B1 | 10/2007 | Plunk et al. | |
| 7,296,911 | B2 | 11/2007 | Plunk et al. | |
| 7,922,351 | B2 * | 4/2011 | Welker | 362/217.11 |
| 2002/0136001 | A1 | 9/2002 | Lefkovitz et al. | |
| 2007/0211457 | A1 | 9/2007 | Mayfield, III et al. | |
| 2007/0253205 | A1 | 11/2007 | Welker | |

* cited by examiner

SURFACE MOUNTED LIGHTING FIXTURE

CROSS-REFERENCE TO RELATED APPLICATIONS

This application claims the benefit of U.S. Provisional Application No. 61/201,530, entitled "Surface Mounted Lighting Fixture" and filed Dec. 11, 2008, the entirety of which is herein incorporated by reference.

FIELD OF THE INVENTION

Embodiments of the invention relate to surface mounted lighting fixtures.

BACKGROUND OF THE INVENTION

Surface-mounted lighting fixtures are mounted to the surface of the ceiling so as to extend below the ceiling plane. Typical surface mounted fixtures include a rectilinear housing formed with a back, side walls, and end walls. The lamps and electrical components are housed in the housing, and the entire fixture is mounted on the ceiling via the back of the housing. Building the housing with an integral back typically requires either welding, mechanical assembly or an inefficient use of sheet steel materials, all of which increase fabrication costs.

Moreover, the housing's boxy internal shape is not ideal for fixture efficiency. More specifically, light emitted from the lamps can get trapped in the housing corners. Thus, not all of the emitted light reaches the intended target below the housing. To improve efficiency, separate, contoured internal surfaces (such as angled reflectors) are coupled to the housing to help direct the light efficiently out of the box and enclose the electrical components such as the wiring and ballast. The need for these additional surfaces increases the material and fabrication costs.

Thus, there exists a need for a surface mounted lighting fixture that performs as efficiently as traditional fixtures but results in fabrication savings.

SUMMARY OF EMBODIMENTS OF THE INVENTION

Embodiments of the invention include surface mounted lighting fixtures having a troffer channel and a frame that extends around the troffer channel. The troffer channel includes a top wall and side walls. To impart a "back" to the fixture, the troffer channel is positioned in the frame so that the upper surface of the lighting fixture is defined by the top wall of the troffer channel and so that the fixture is mounted to a ceiling via the top wall of the troffer channel. The side walls of the troffer channel are preferably angled relative to the top wall to reflect light out of the fixture as desired. Tie brackets, lamp holder brackets, electrical components, and traditional louvers and lensed door components may be supported by the lighting fixture.

An installation bracket may be provided to facilitate installation of the lighting fixture. Such brackets may be mounted to the ceiling and used to suspend the fixture to allow the installer to perform the necessary wiring and other preparation work prior to securing the fixture directly to the ceiling via the troffer channel.

DETAILED DESCRIPTION OF EMBODIMENTS OF THE INVENTION

Figure 1:
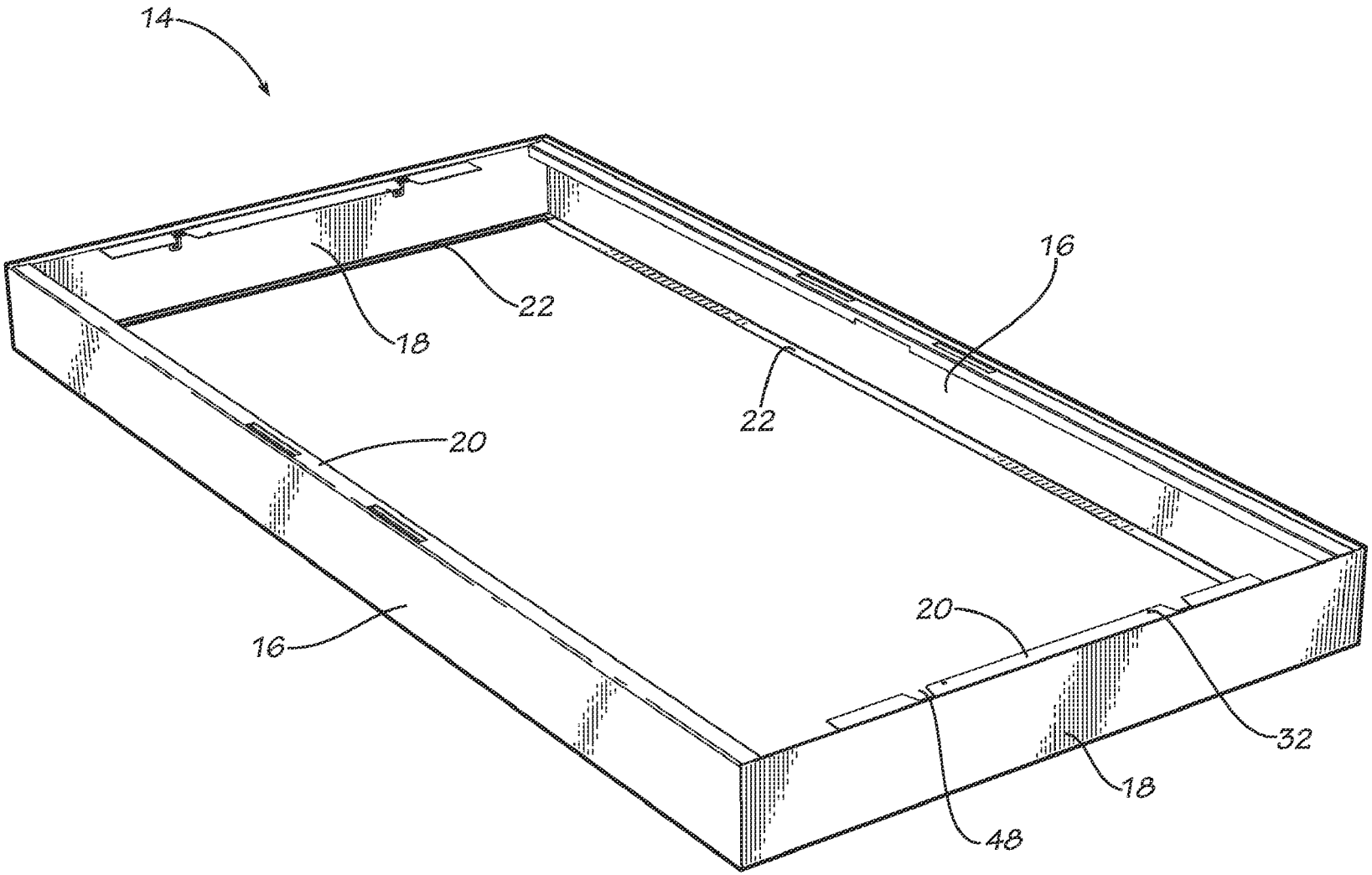
FIG. 1 is a top perspective view of the frame of one embodiment of the lighting fixture.
Figure 2A:
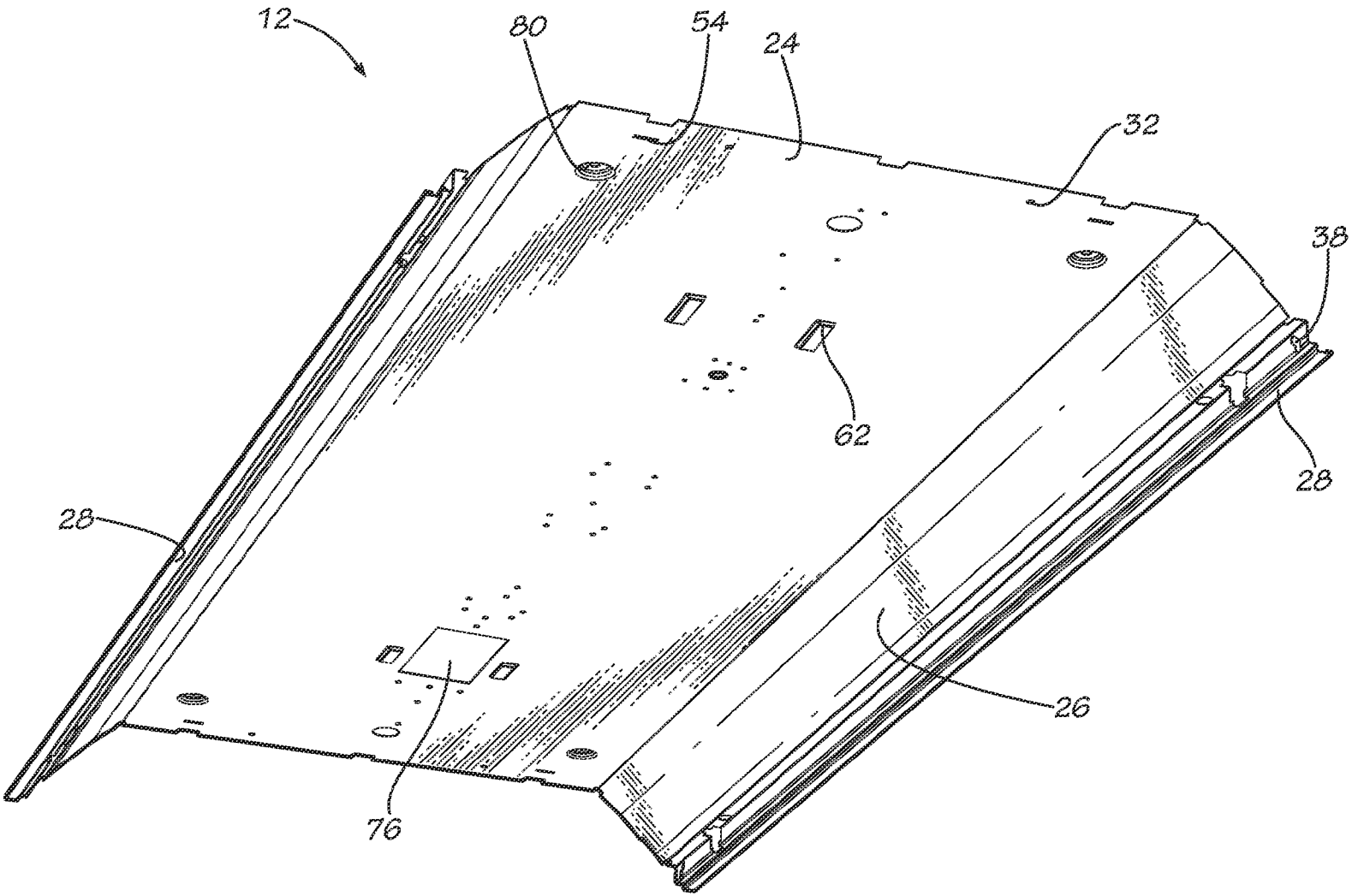
FIG. 2*a* is a bottom perspective view of the troffer channel of one embodiment of the lighting fixture.
Figure 2B:
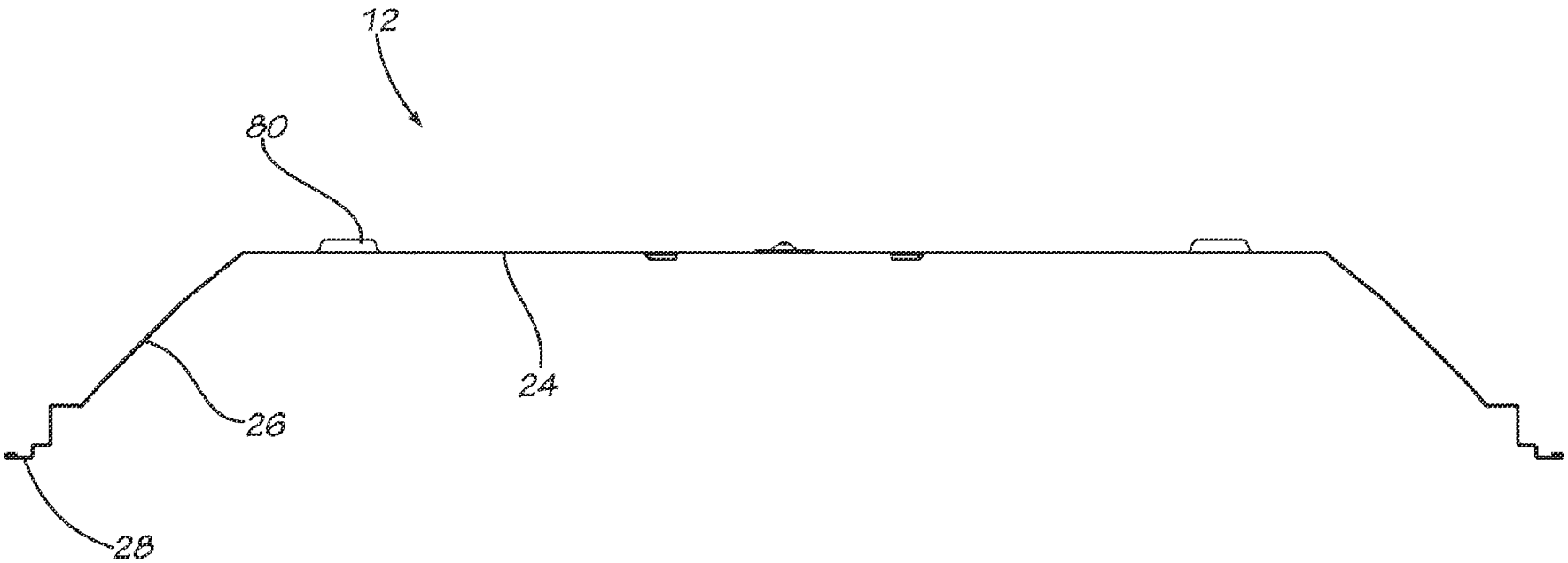
FIG. 2*b* is a side elevation view of the troffer channel of FIG. 2*a*.

Embodiments of the invention include a surface mounted lighting fixture 10 that includes a troffer channel 12 and a frame 14 that extends around the sides and ends of the troffer channel 12. The frame 14 is formed of side panels 16 and end panels 18. Top flanges 20 extend from the top of the side and end panels 16, 18, and bottom flanges 22 extend from the bottom of the side and end panels 16, 18. The frame 14 may be formed of any material having suitable structural integrity, including but not limited to polymeric and metallic materials. In one embodiment, the side and end panels 16, 18 are formed of 22 gauge steel. While the panels 16, 18 may be integrally-formed, in one embodiment they are welded together to form the frame 14. The frame 14 may be painted with a decorative coating. The frame 14 serves as a decorative cover for the troffer channel 12 and components assembled therein, and, as discussed below, may facilitate attachment of the fixture 10 to a ceiling surface.

Traditional fixture housings typically have a back so as to form a box. The present frame, however, does not have such a back. To impart a "back" to the fixture, a troffer channel 12 is positioned in the frame 14. The troffer channel 12 includes a top wall 24 and side walls 26. The side walls 26 are preferably, but not necessarily, angled between 30°-70° relative to the top wall 24. In this way, they serve to reflect light out of the fixture 10 as desired.

Figure 3:
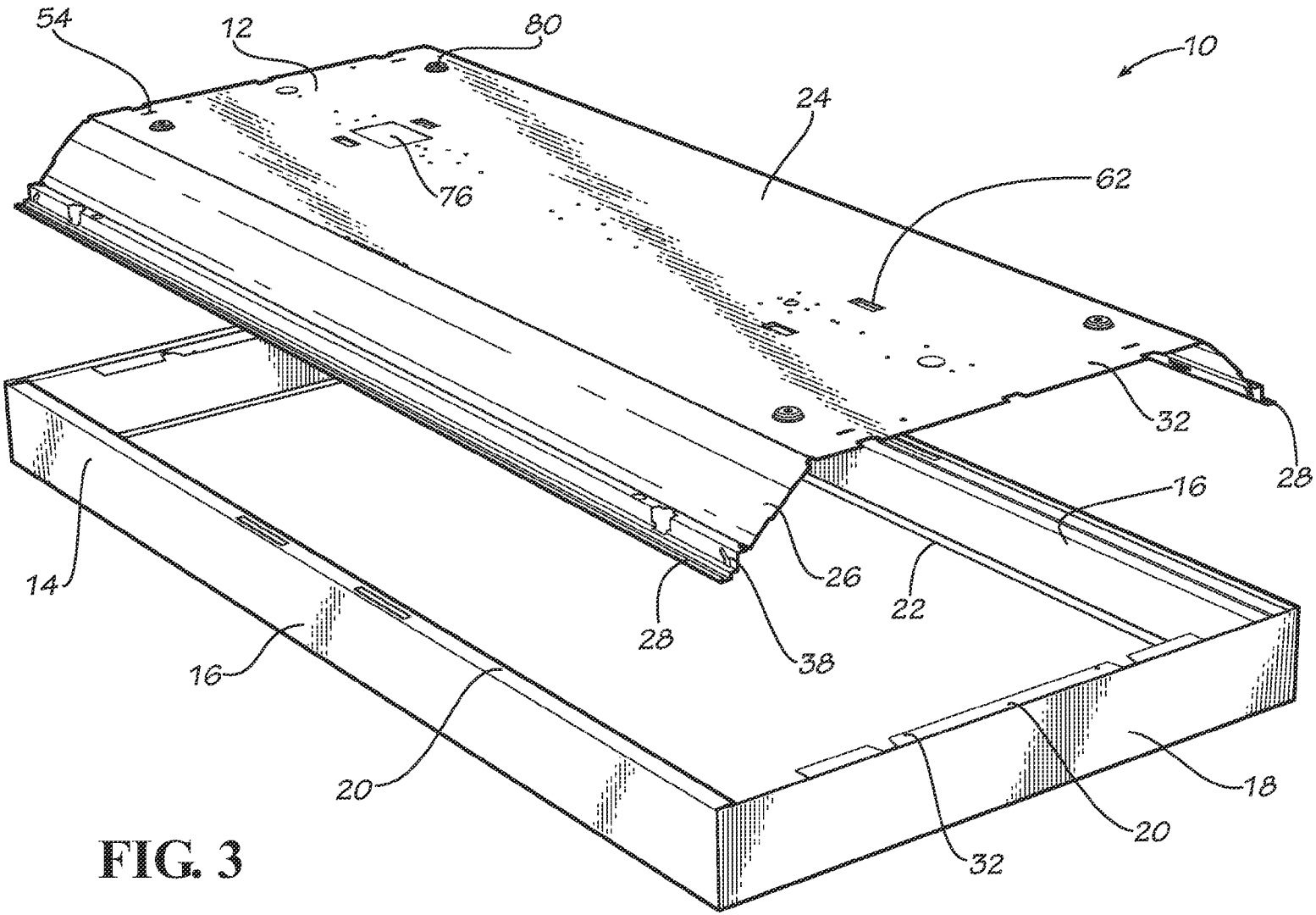
FIG. 3 is an exploded view of the troffer channel of FIGS. 2*a* and 2*b* being positioned in the frame of FIG. 1.
Figure 4A:
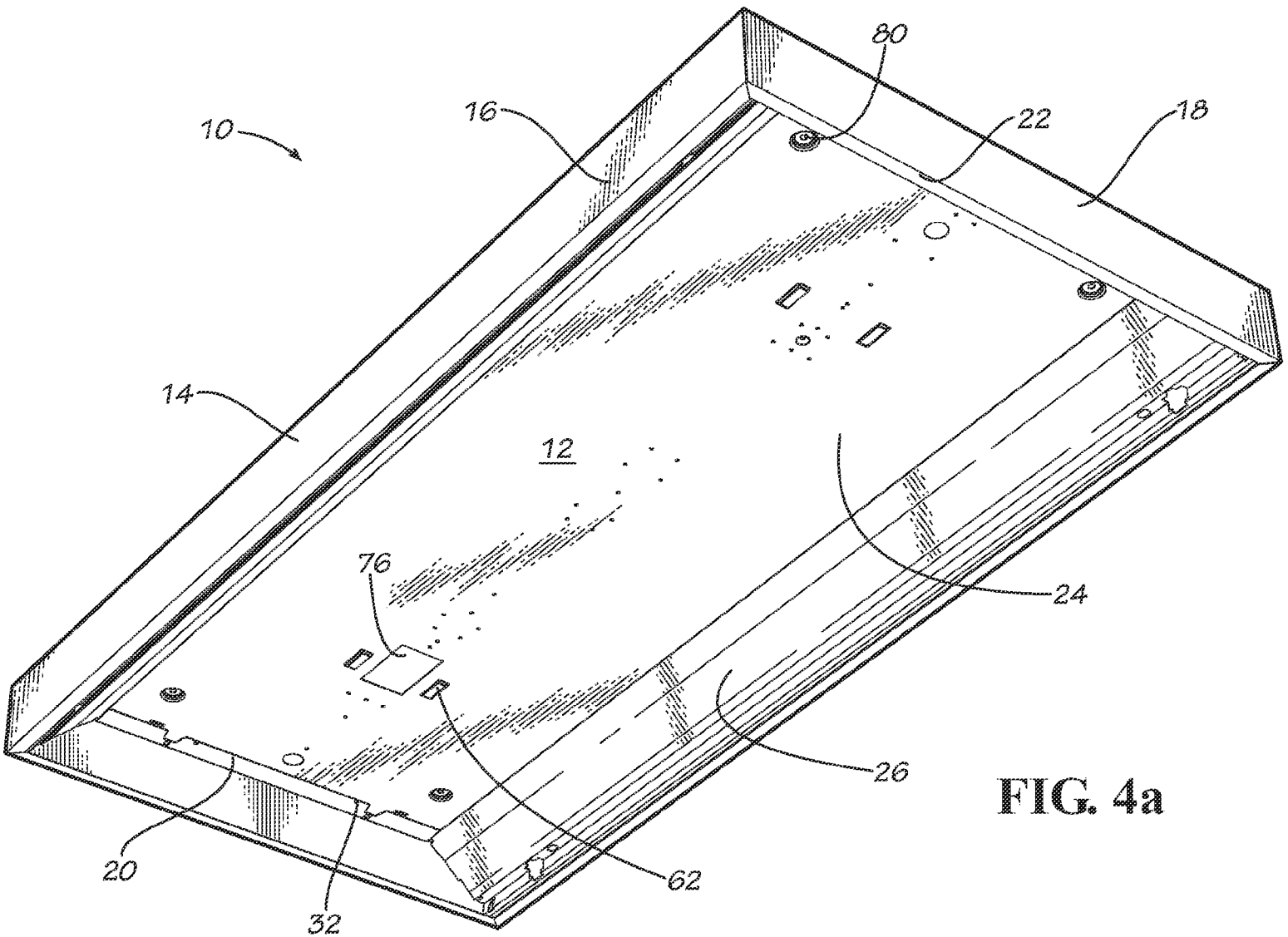
FIG. 4*a* is a bottom perspective view of the troffer channel of FIGS. 2*a* and 2*b* positioned in the frame of FIG. 1.
Figure 4B:
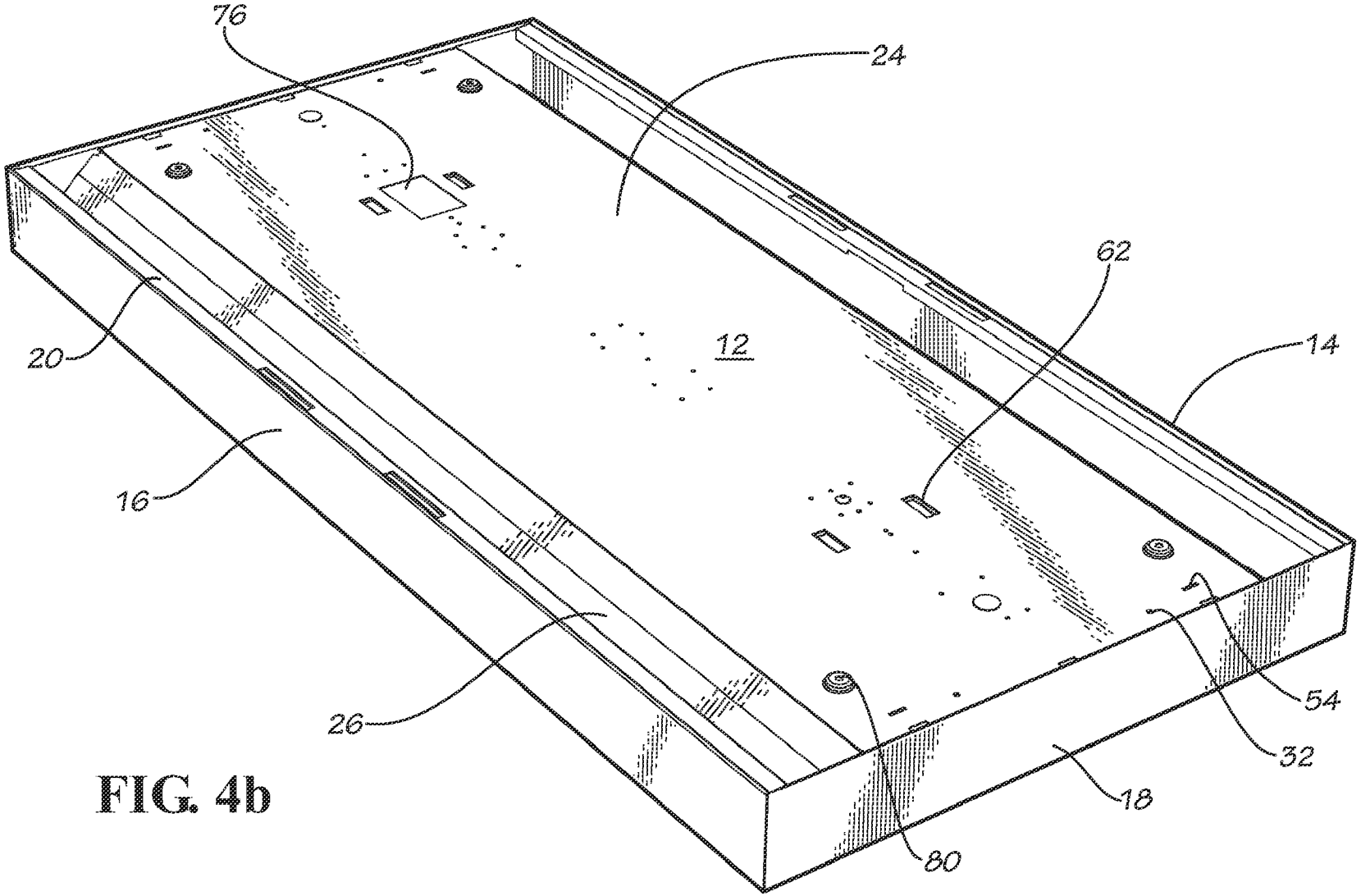
FIG. 4*b* is a top perspective view of the troffer channel of FIGS. 2*a* and 2*b* positioned in the frame of FIG. 1.

Flanges 28 preferably extend outwardly from the side walls 26 of the troffer channel 12. When the troffer channel 12 is positioned in the frame 14 (see FIGS. 3 and 4), the flanges 28 rest on the bottom flanges 22 of the side panels 16 of the frame 14. The top wall 24 of the troffer channel 12 and the top flanges 20 extending from the end panels 18 of the frame 14 are provided with apertures 32 that align when the troffer channel 12 is positioned in the frame 14. When so positioned, fasteners (not shown) may be inserted through the apertures 32 of the troffer channel 12 and top flanges 20 to secure the troffer channel 12 to the frame 14.

Figure 5:
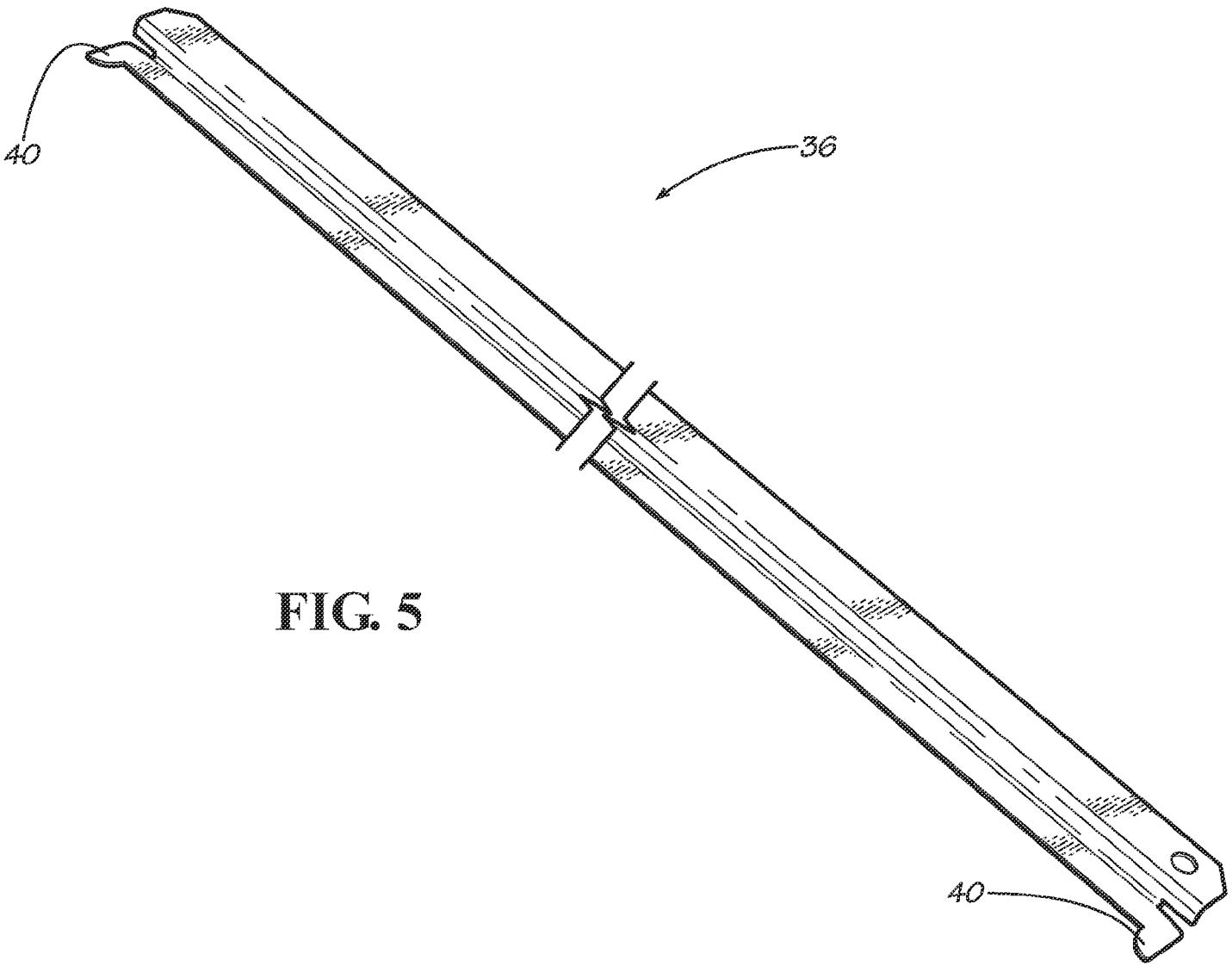
FIG. 5 is a perspective view of one embodiment of a tie bracket.
Figure 6:
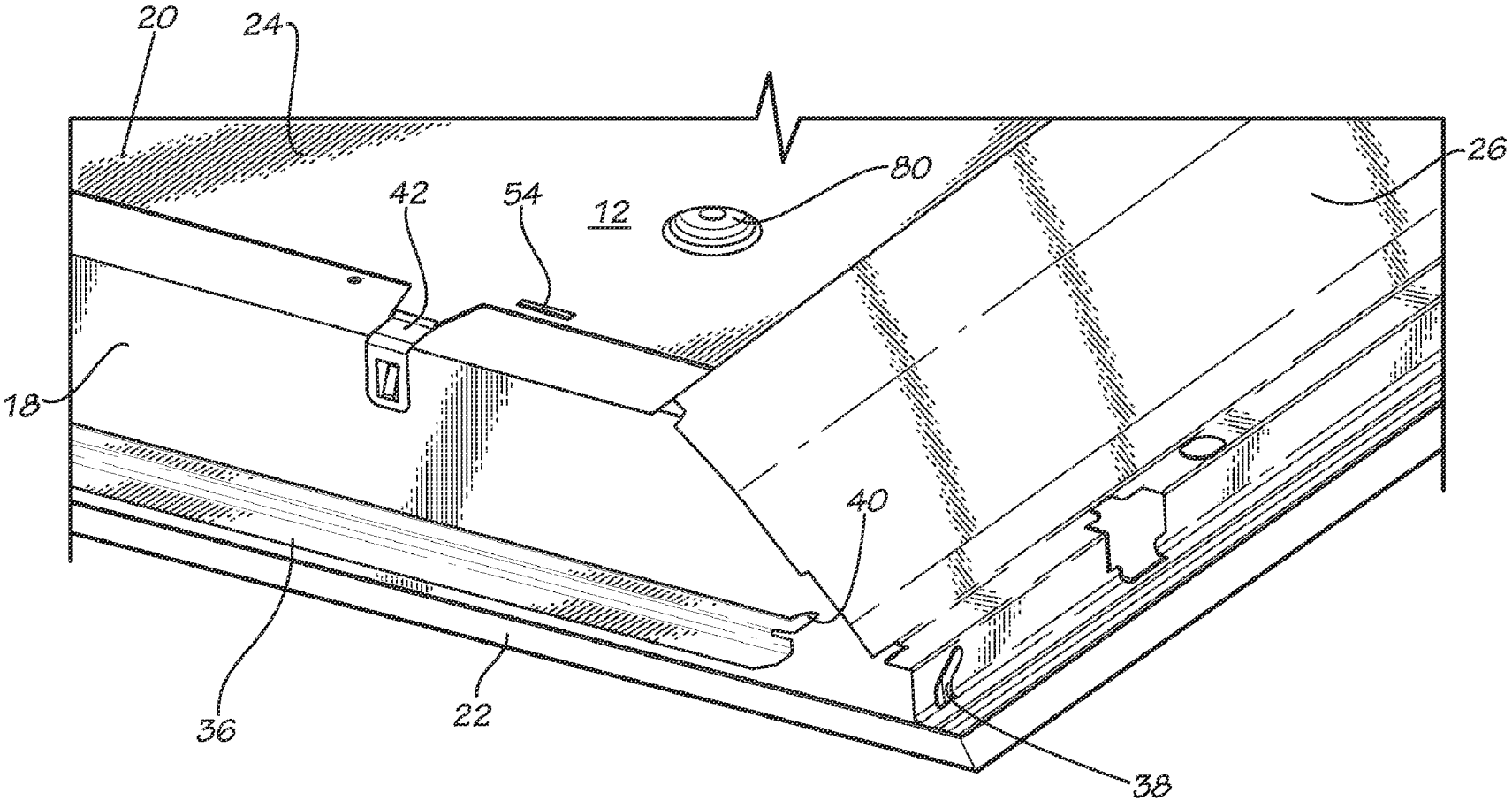
FIG. 6 is a fragmentary perspective view of the tie bracket of FIG. 5 being positioned in the assembly of FIGS. 4*a* and 4*b*.
Figure 7:
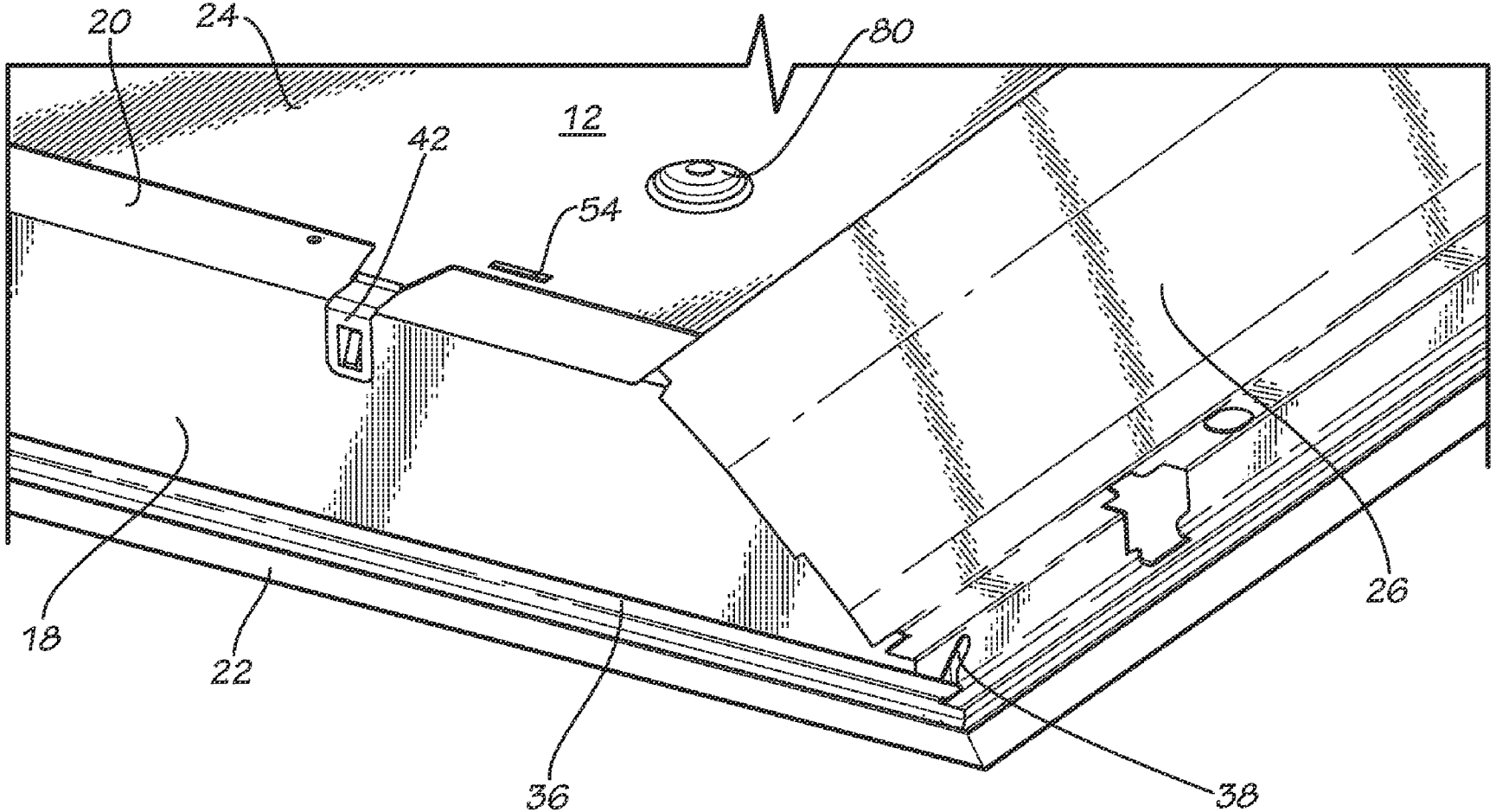
FIG. 7 is a fragmentary perspective view of the tie bracket of FIG. 5 positioned in the assembly of FIGS. 4*a* and 4*b*.

Tie brackets 36 (see FIGS. 5-7) are preferably, but not necessarily, provided to ensure that the troffer channel 12 remains at the desired width within the frame 14. The side walls 26 of the troffer channel 12 preferably, but not necessarily, include tie bracket slots 38 that receive flanges 40 on the ends of the tie brackets 36. The tie brackets 36 seat on the bottom flanges 22 of the end panels 18 of the frame 14. When positioned in the troffer channel 12, the tie brackets 36 span the width of each end of the troffer channel 12 to retain it at the desired width.

Figure 8:
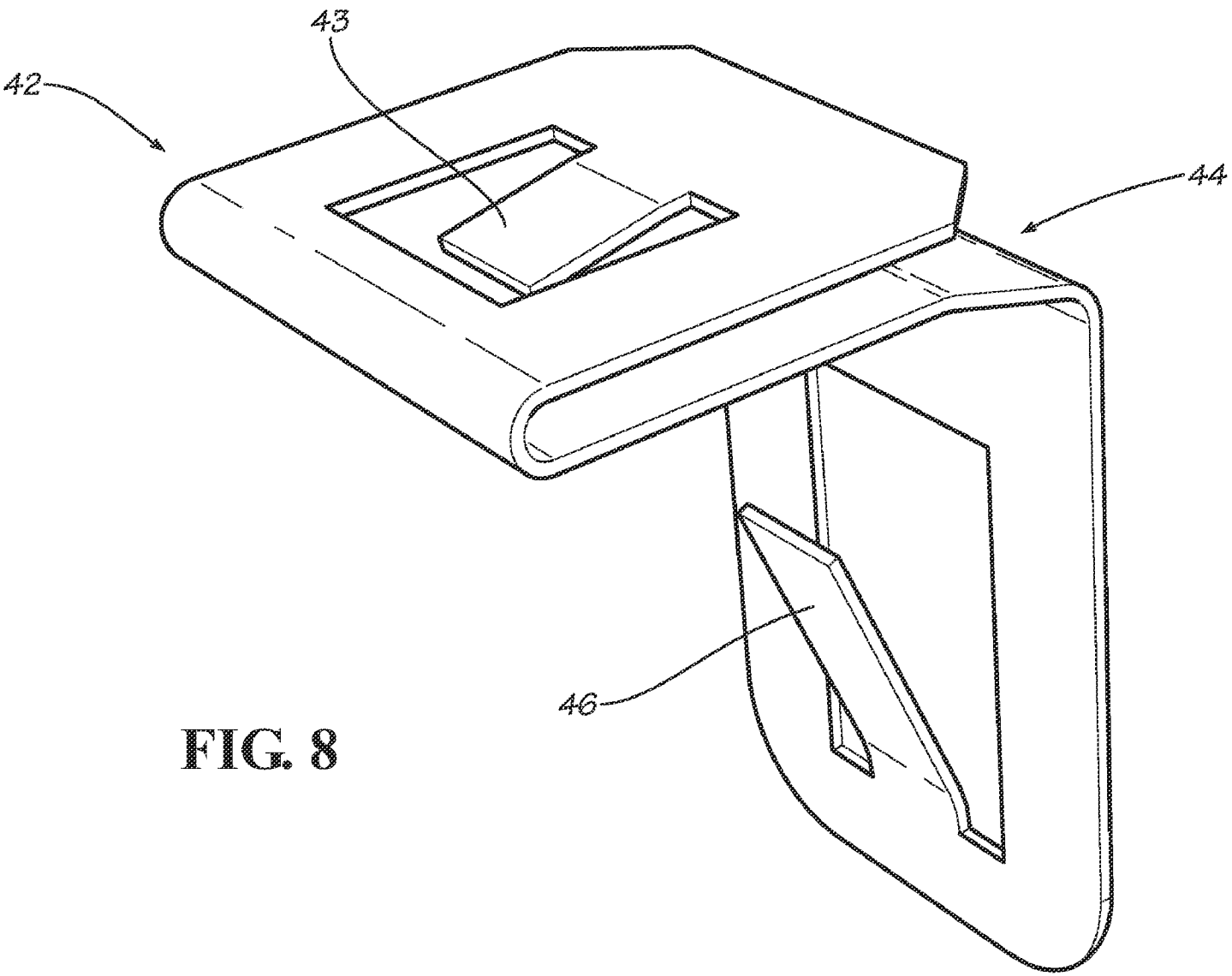
FIG. 8 is a top perspective view of one embodiment of a lamp holder clip.
Figure 9:
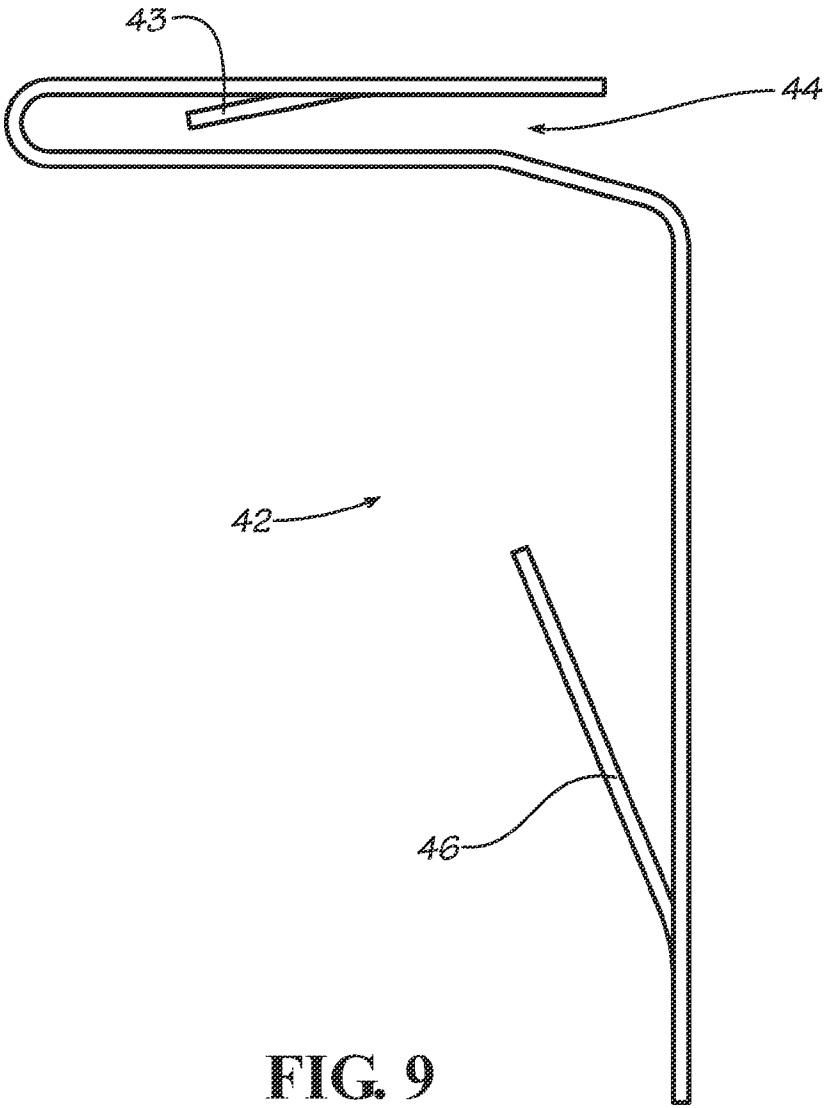
FIG. 9 is a side elevation view of the lamp holder clip of FIG. 8.
Figure 10:
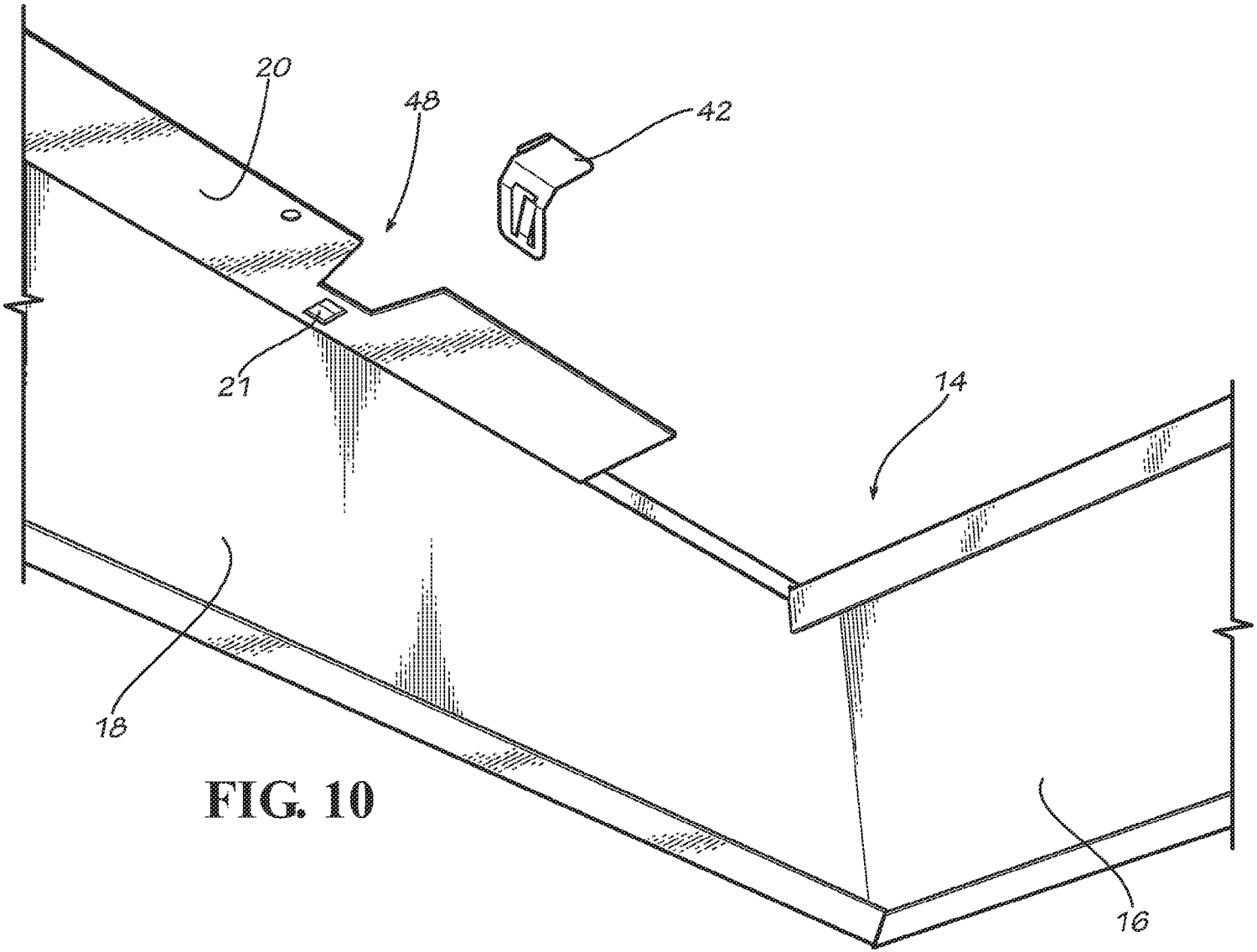
FIG. 10 is a fragmentary perspective view of the lamp holder clip of FIG. 8 being positioned on the frame of FIG. 1.
Figure 11:
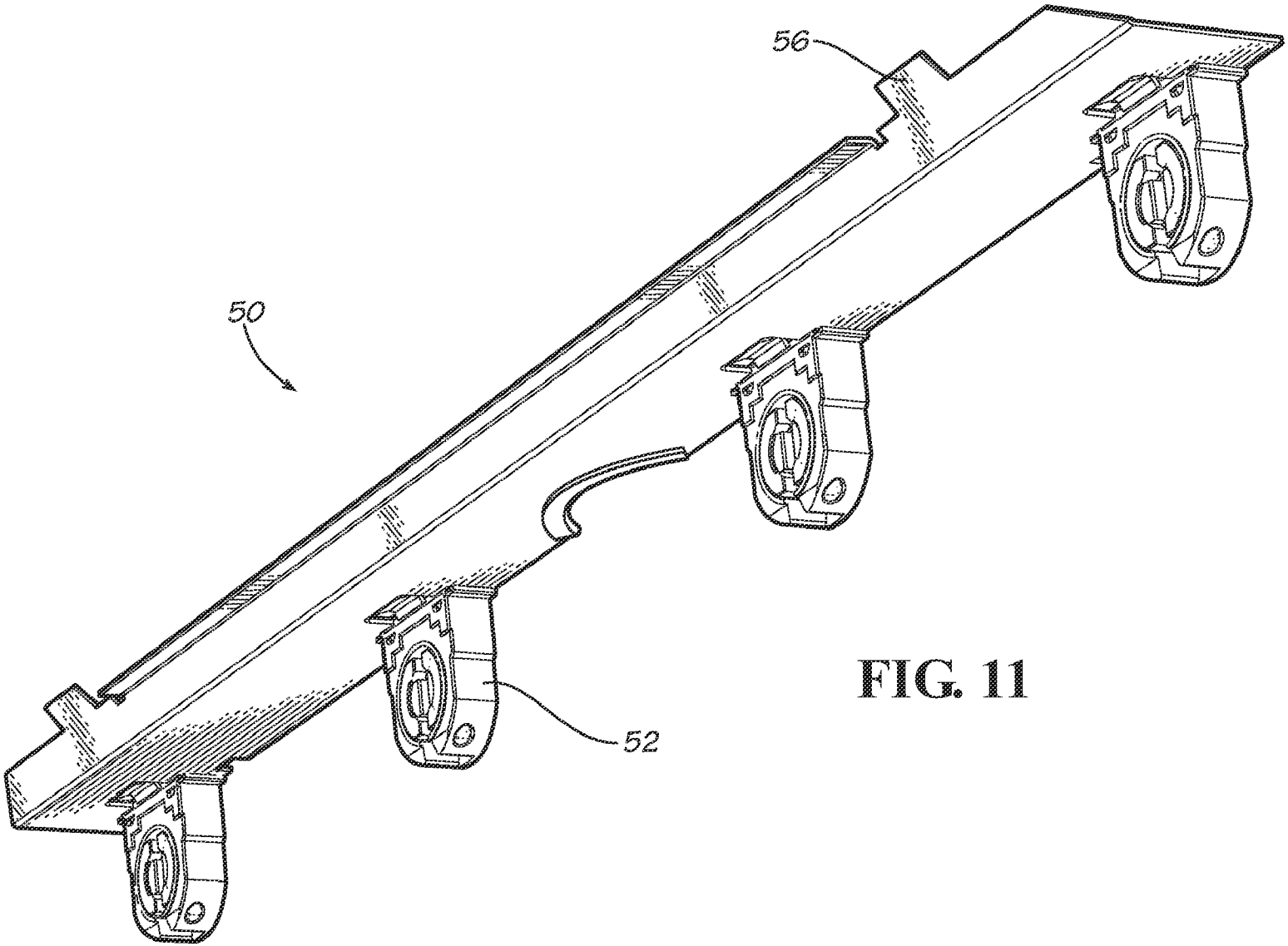
FIG. 11 is a bottom perspective view of one embodiment of a lamp holder bracket.
Figure 12:
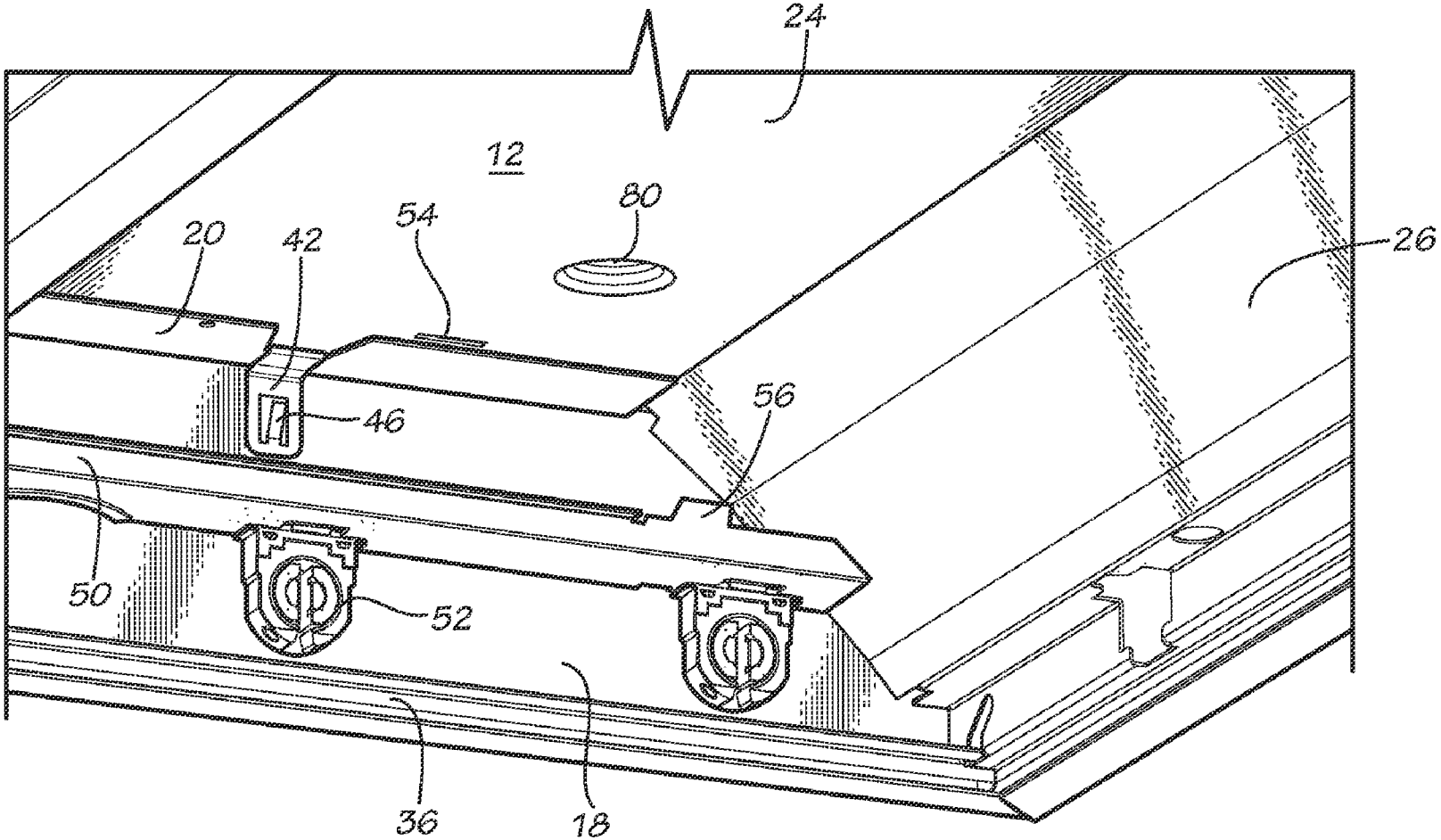
FIG. 12 is a fragmentary perspective view of the lamp holder bracket of FIG. 11 being positioned on the lamp holder clip of FIGS. 8-10.
Figure 13:
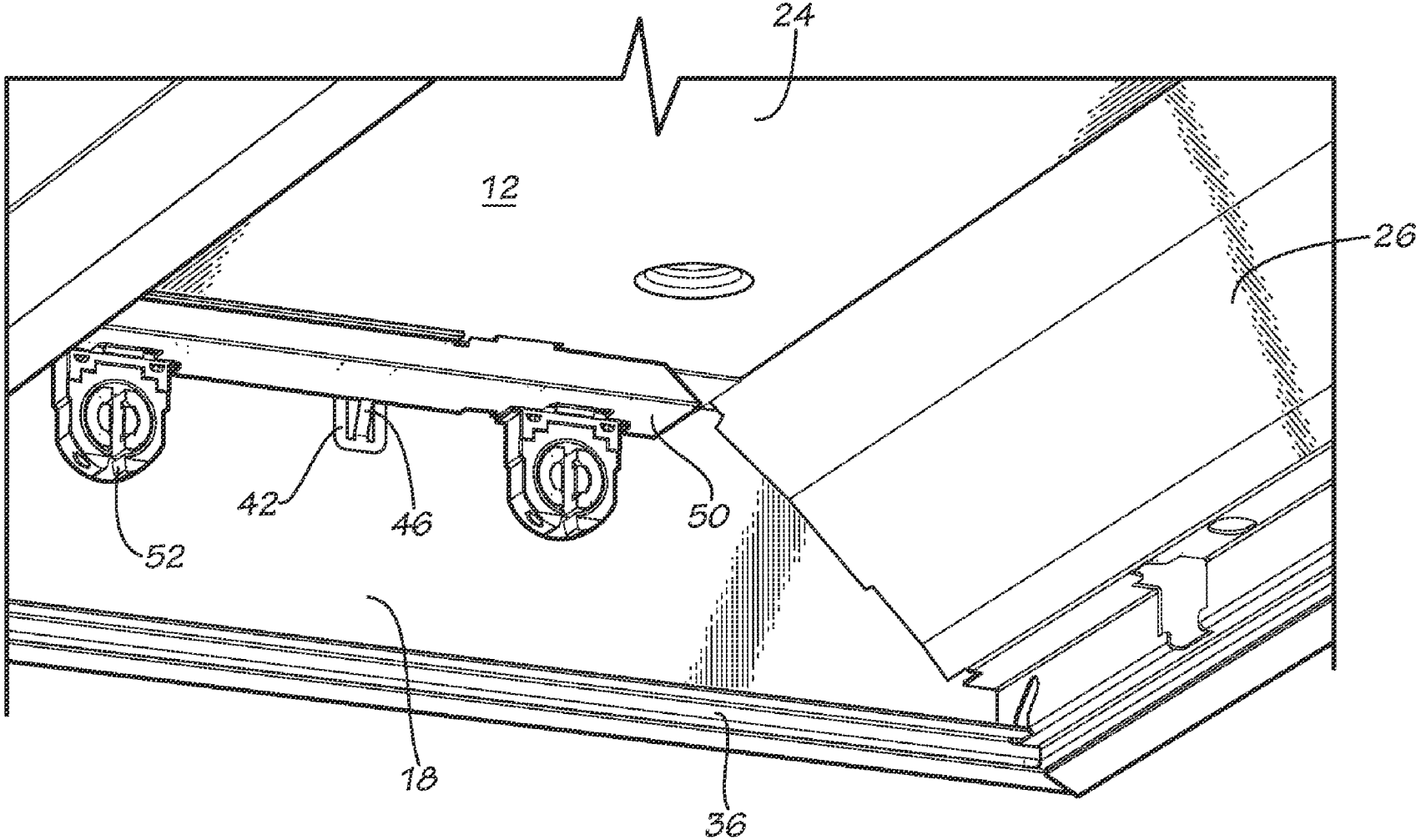
FIG. 13 is a fragmentary perspective view of the lamp holder bracket of FIG. 11 positioned on the lamp holder clip of FIGS. 8-10.

Lamp holder clips 42 are preferably mounted on the end panels 18 of the frame 14. One embodiment of a lamp holder clip 42 is shown in FIGS. 8-10. The lamp holder clip 42 includes a recess 44 and a resilient tongue 46. To mount the lamp holder clip 42 on an end panel 18 of the frame 14, the recess 44 of a lamp holder clip 42 receives a portion of the top flange 20 of the end panel 18 of the frame 14. In some embodiments, the recess 44 of the lamp hold clip 42 is positioned in an indentation 48 along the top flange 20 of the end panel 18. In this way, the lamp holder clip 42 is positioned closer to the end panel 18. In the disclosed embodiment, an optional tongue 43 extends from the lamp holder clip 42 and into the recess 44. The tongue 43 is designed to engage a recess 21 in the top flange 20 of the end panel 18 to help retain the lamp holder clip 42 on the frame 14. One of skill in the art will readily understand that the lamp holder clips 42 may have different shapes and may be mounted and secured on the frame 14 in different ways. Traditional lamp holder brackets 50 (see FIGS. 11-13) with associated lamp sockets 52 may then be mounted on the clips 42 via engagement with the resilient tongue 46. Slots 54 may be provided in the top wall 24 of the troffer channel 12 to receive a tongue 56 that extends from the lamp holder brackets 50.

Figure 14:
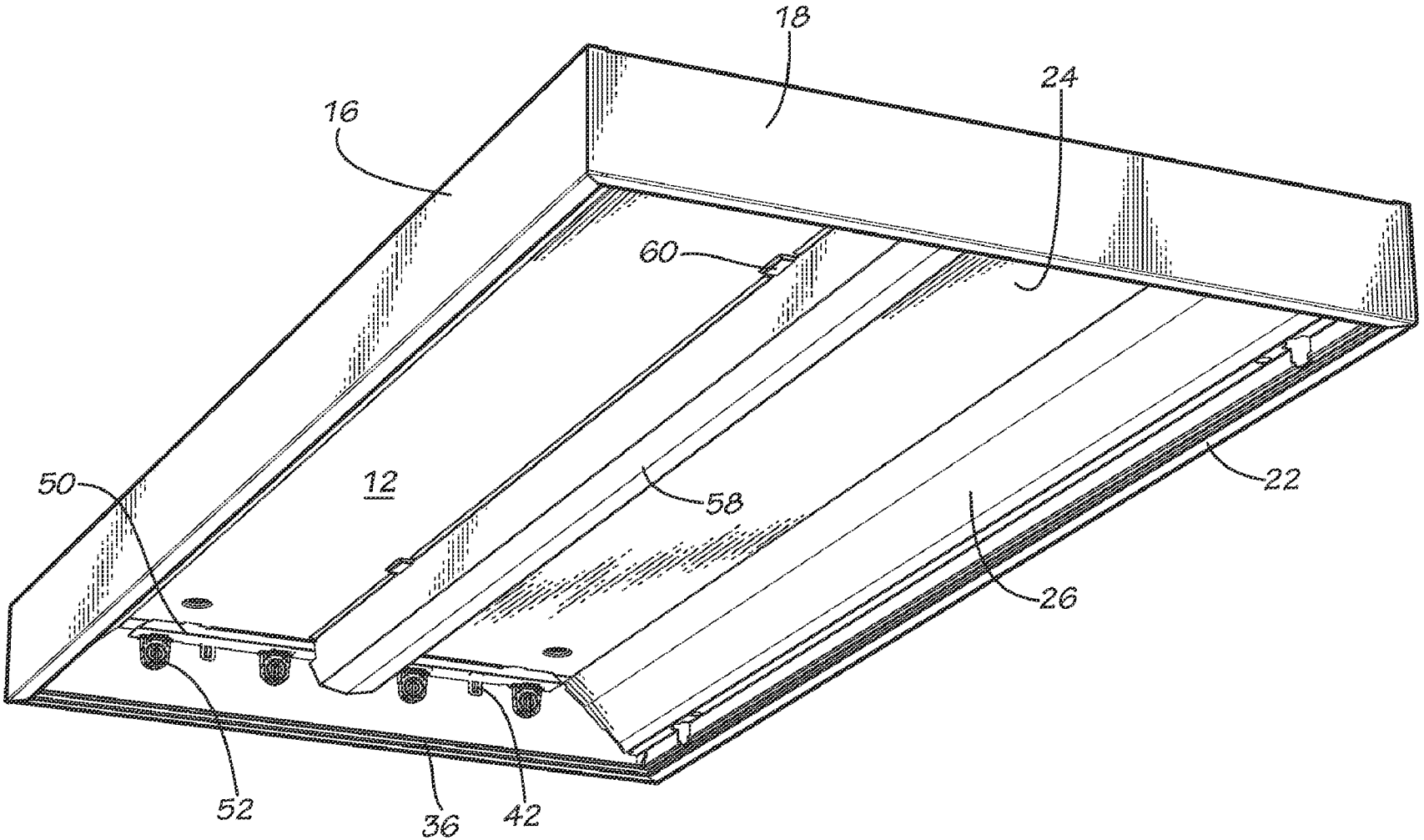
FIG. 14 is a bottom perspective view of an embodiment of the lighting fixture.
Figure 15:
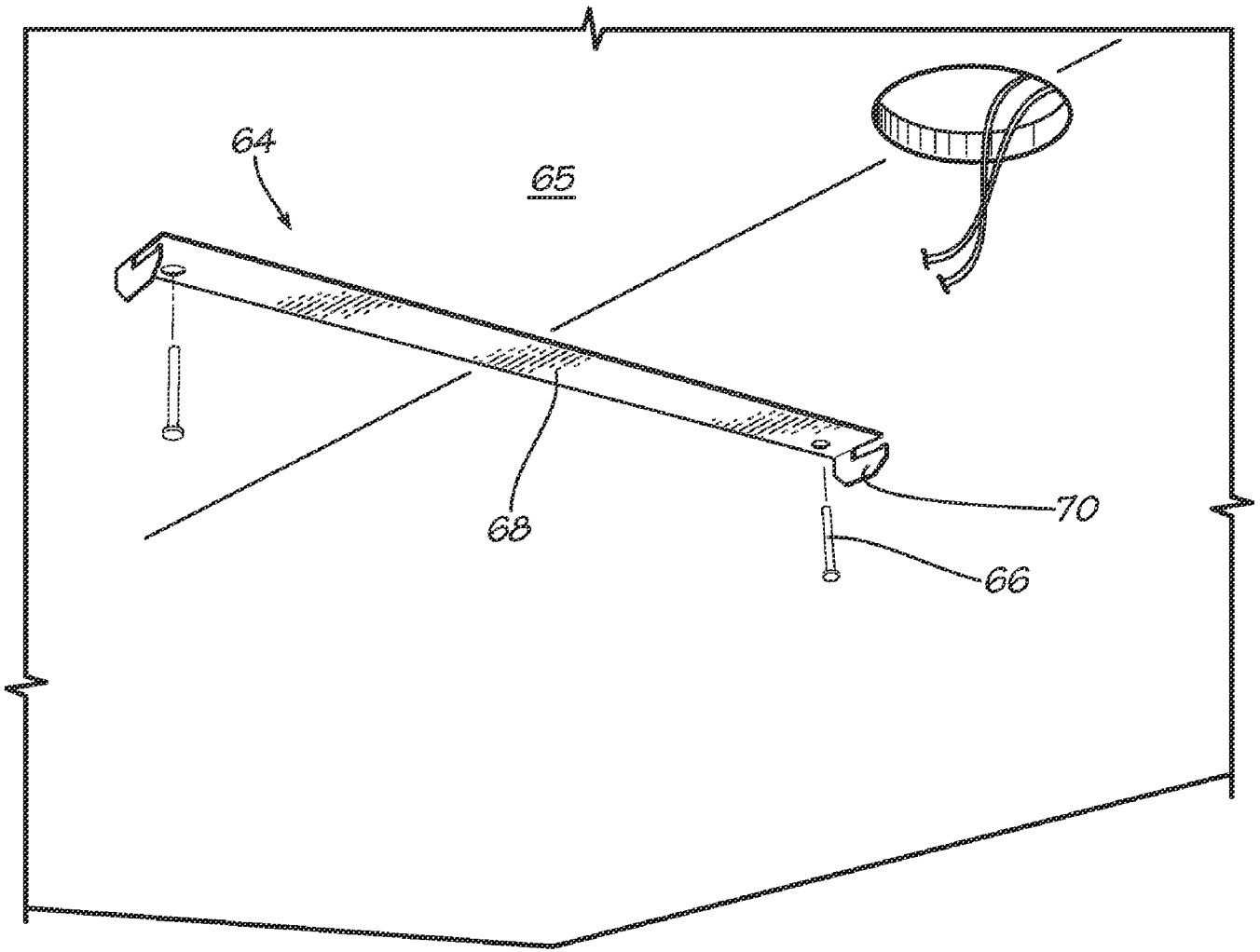
FIG. 15 is a bottom perspective view of an embodiment of an installation bracket.

The top wall 24 of the troffer channel 12 serves as a mounting surface for electrical components (e.g., a ballast or other power source) as well as the back of the fixture. Any number of apertures may be provided in the top wall of the troffer channel to facilitate such mounting. Moreover, a channel cover 58 (see FIG. 14) may be positioned over such components and retained in the fixture 10 by the troffer channel 12. In one, non-limiting embodiment, wings 60 extending from the edges of the channel cover 58 are received in recesses 62 (see FIGS. 3 and 4) provided on the top wall 24 of the troffer channel 12. While not shown or discussed in detail herein, one of skill in the art will understand that the troffer channel 12 may also be equipped with standard hinges and latches to attach traditional louvers and lensed door components to the lighting fixture 10.

An installation bracket 64 may be provided to facilitate installation of the lighting fixture 10. Installing a typical surface commercial fixture to the ceiling usually requires two individuals. The size and weight of the fixture are cumbersome for one installer to manage adequately. Embodiments of the invention provide unique installation brackets that easily allow one person to install the fixture 10 securely to a ceiling.

Figure 16:
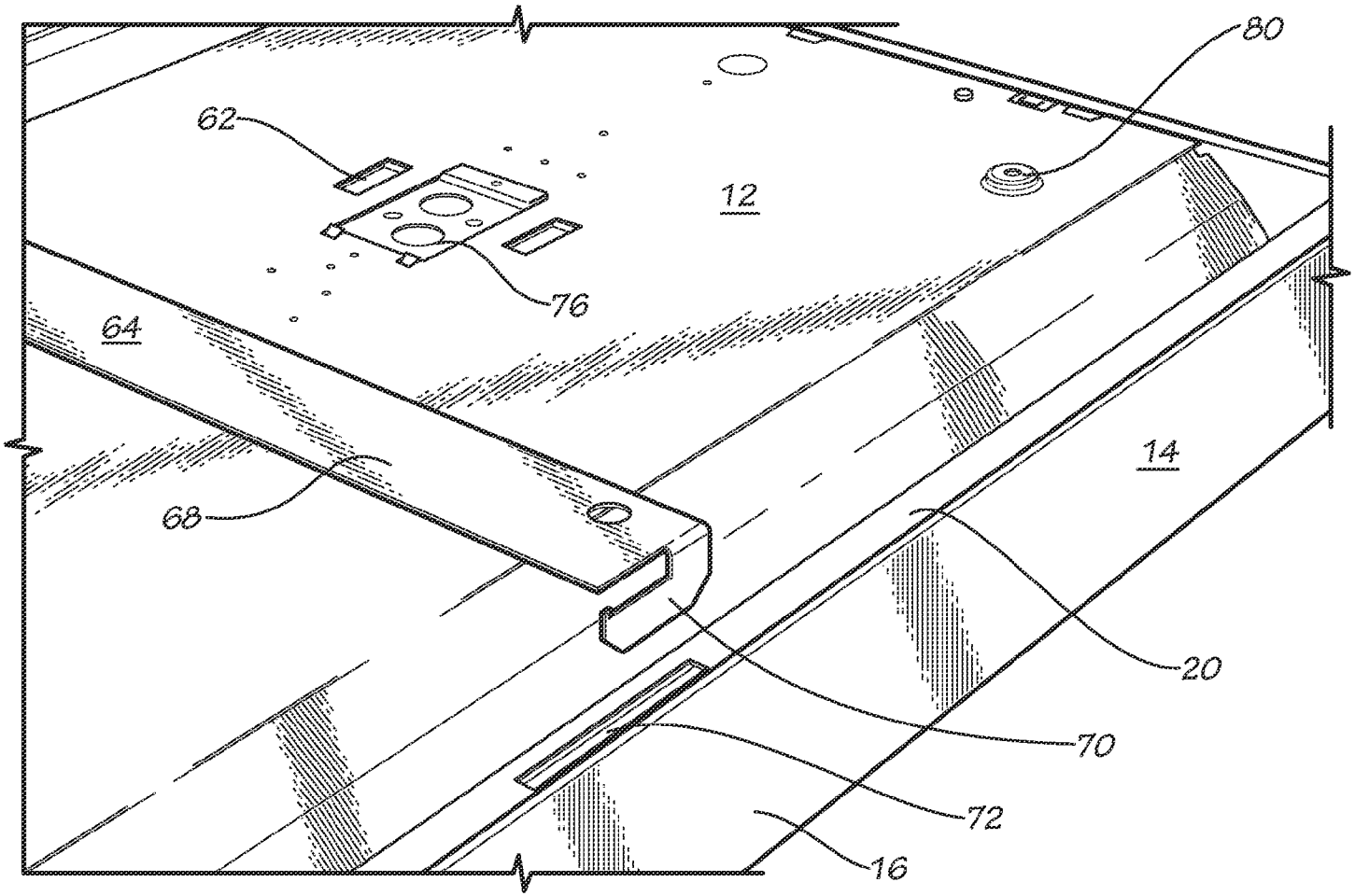
FIG. 16 is a top fragmentary perspective view of the lighting fixture of FIGS. 1-14 being mounted on the installation bracket of FIG. 15.
Figure 17:
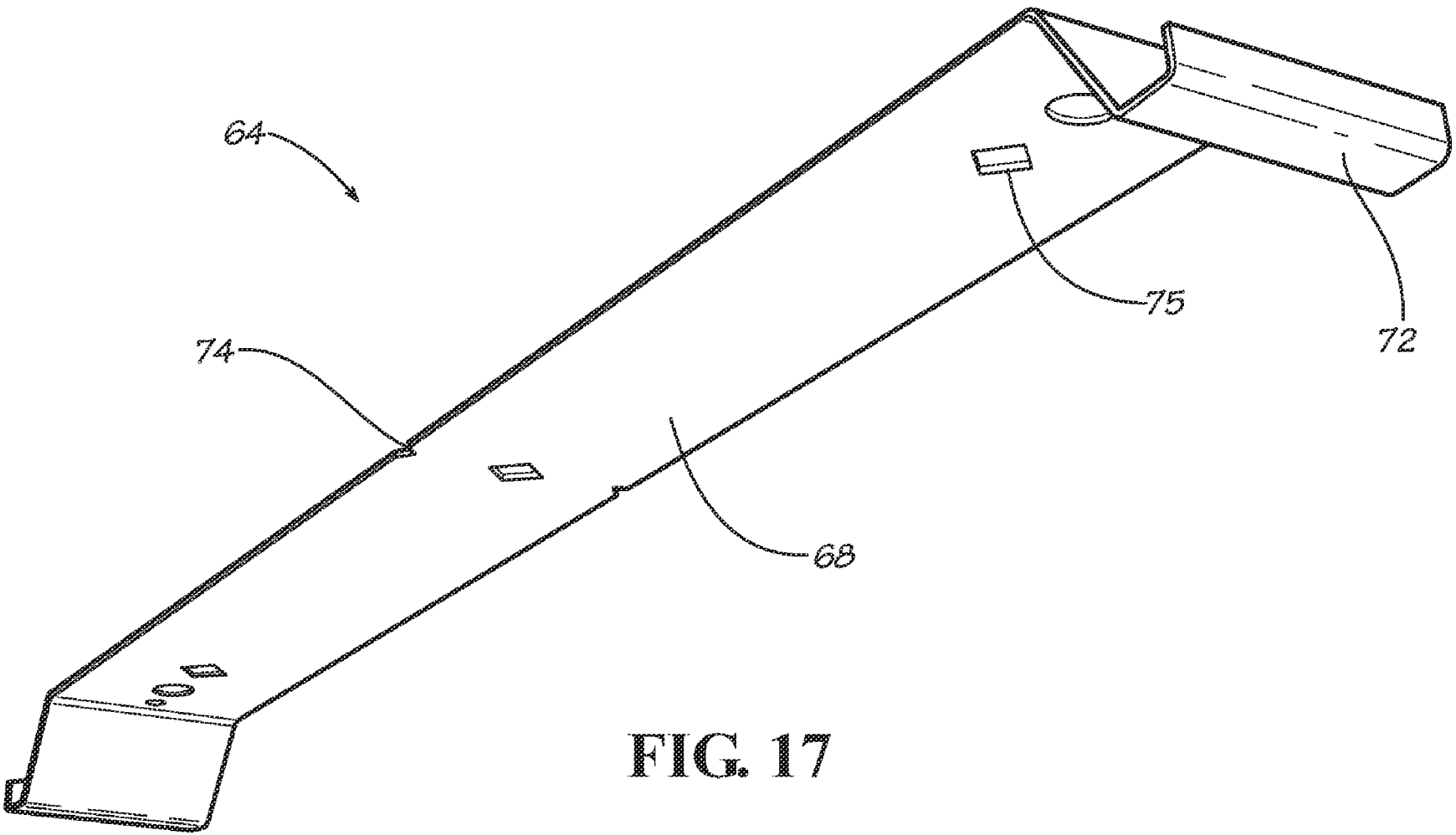
FIG. 17 is a bottom perspective view of another embodiment of an installation bracket.
Figure 18:
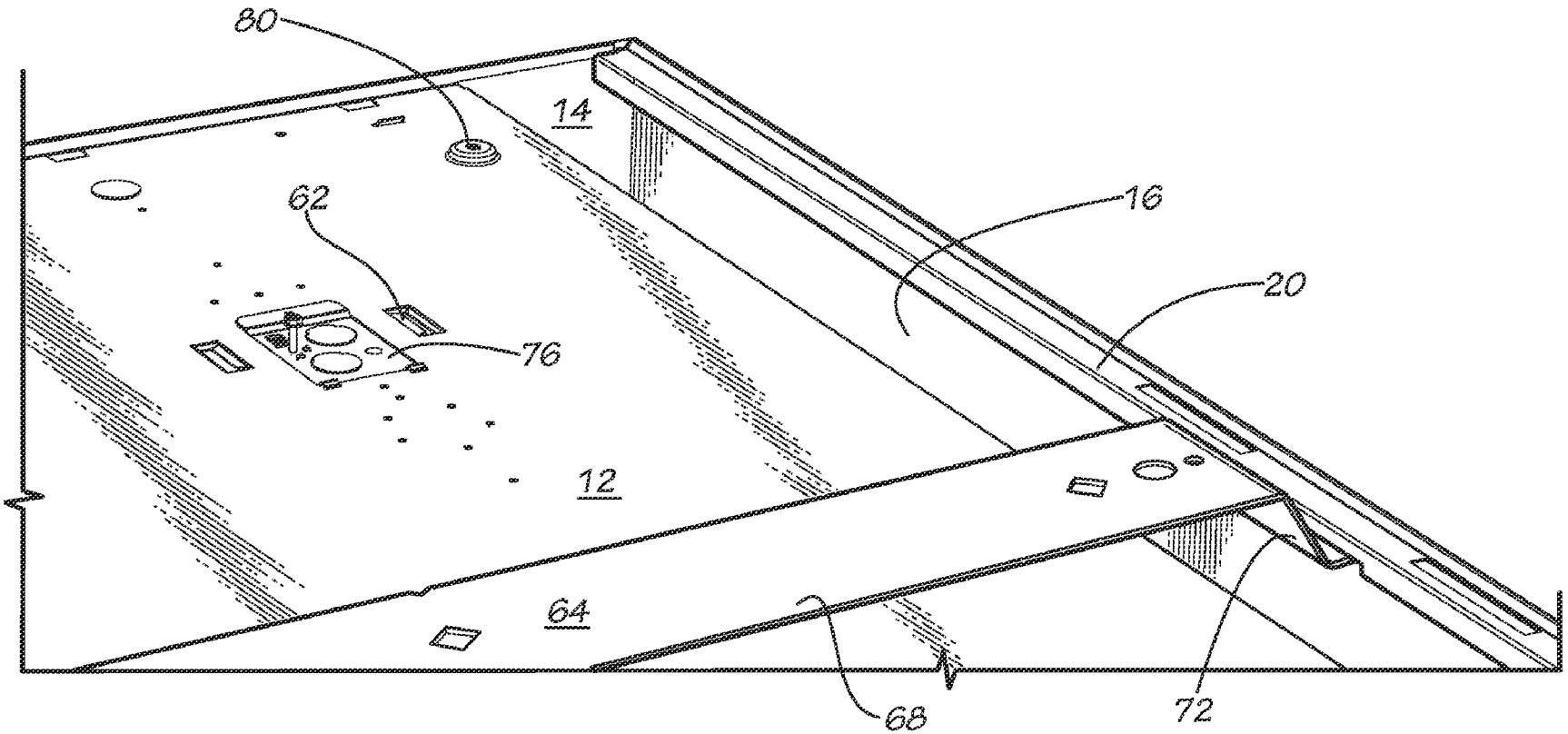
FIG. 18 is a fragmentary perspective view of the lighting fixture of FIGS. 1-14 being mounted on the installation bracket of FIG. 17.

The installation bracket 64 is first affixed to the adjacent ceiling 65 with screws or other mechanical fasteners 66. Then the assembled lighting fixture 10 is hung onto the bracket 64. In one embodiment, the installation bracket 64 includes a central body 68 and arms 70 that extend from the central body 68. The lighting fixture 10 is hung on the bracket 64 by engagement of the bracket arms 70 into slots 72 provided in the frame 14 and more specifically in the top flanges 20 of the side panels 16 of the frame 14 (see FIG. 16). In an alternative embodiment (see FIG. 17), the bracket 64 includes wings 72 that extend from the central body 68 of the bracket 64. The bracket 64 is installed so that the wings 72 face upwardly and engage the underside of the top flanges 20 of the side panels 18 of the frame 14 to support the fixture 10 (see FIG. 18). The installation brackets 64 may be made from any material having suitable structural integrity and strength to withstand the weight of the fixture 10. Suitable materials include, but are not limited to, polymeric and metallic materials. In one embodiment, the installation bracket 64 is made from steel.

Wiring is routed into the fixture 10 via an access plate 76 provided in the troffer channel 12, and the fixture 10 is aligned as desired. Alignment indicia may be provided on the installation bracket 64 to facilitate such alignment. By way only of example, alignment notch(es) 74 may be provided along the sides of the installation bracket 64 to assist with lateral positioning of the fixture 10 on the ceiling 65. In other embodiments, alignment apertures 75 may be provided in the installation bracket 64 to assist with lateral and/or longitudinal positioning of the fixture 10 on the ceiling 65. Finally, the fixture 10 is secured to the ceiling 65 with additional screws or mechanical fasteners (not shown) inserted into mounting apertures 80 in the troffer channel 12. This process is quickly and easily performed by one installer, yielding a installation labor cost savings. In the resulting installation, the fixture is mounted to the ceiling via the top wall 24 of the troffer channel 12, which consequently defines the top of the fixture (as opposed to traditional surface mounted lighting fixtures which are mounted via the back wall of the frame).

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A surface mounted lighting fixture comprising an upper surface for positioning adjacent a ceiling:

a. a frame comprising side panels and end panels; and b. a troffer channel comprising a top wall and side walls extending downwardly at an angle from the top wall, wherein the troffer channel is received in the frame so that the frame extends around a periphery of the troffer channel, wherein the top wall of the troffer channel defines the upper surface of the lighting fixture and wherein the lighting fixture is adapted to be mounted to the ceiling via the top wall of the troffer channel.

2. The lighting fixture of claim 1, wherein each side wall comprises a flange that extends outwardly from the side wall distal the top wall of the troffer channel and wherein the frame comprises bottom flanges that extend from the side panels of the frame, wherein, when the troffer channel is received in the frame, the flanges of the side walls of the troffer channel rest on the bottom flanges.

3. The lighting fixture of claim 1, further comprising at least one lamp holder clip mounted on the frame.

4. A surface mounted lighting fixture comprising an upper surface for positioning adjacent a ceiling:

a. a frame comprising side panels and end panels; and b. a troffer channel comprising a top wall and side walls extending downwardly at an angle from the top wall, wherein the troffer channel is received in the frame so that the frame extends around a periphery of the troffer channel, wherein the top wall of the troffer channel defines the upper surface of the lighting fixture and wherein the lighting fixture is adapted to be mounted to the ceiling via the top wall of the troffer channel, and wherein the frame comprises at least one top flange that extends from at least one end panel of the frame, wherein the top wall of the troffer channel and the at least one top flange each comprises at least one aperture, and wherein the at least one aperture of the top wall and the top flange align when the troffer channel is received in the frame.

5. The lighting fixture of claim 4, further comprising a fastener positioned in the aligned apertures of the top wall and the top flange to secure the troffer channel to the frame.

6. A surface mounted lighting fixture comprising an upper surface for positioning adjacent a ceiling:

a. a frame comprising side panels and end panels; and b. a troffer channel comprising a top wall and side walls extending downwardly at an angle from the top wall, wherein the troffer channel is received in the frame so that the frame extends around a periphery of the troffer channel, wherein the top wall of the troffer channel defines the upper surface of the lighting fixture and wherein the lighting fixture is adapted to be mounted to the ceiling via the top wall of the troffer channel, and further comprising at least one tie bracket extending between the side walls of the troffer channel, wherein at least one end of the tie bracket comprises a flange and wherein a side wall of the troffer channel comprises a tie bracket slot for receiving the flange of the at least one tie bracket.

7. The lighting fixture of claim 6, wherein the frame comprises at least one bottom flange that extends from one of the end panels of the frame and wherein the tie bracket rests on the at least one bottom flange.

8. A surface mounted lighting fixture comprising an upper surface for positioning adjacent a ceiling:

a. a frame comprising side panels and end panels;

b. a troffer channel comprising a top wall and side walls extending downwardly at an angle from the top wall, wherein the troffer channel is received in the frame so that the frame extends around a periphery of the troffer channel; and c. at least one lamp holder clip mounted on the frame, wherein the top wall of the troffer channel defines the upper surface of the lighting fixture and wherein the lighting fixture is adapted to be mounted to the ceiling via the top wall of the troffer channel, and wherein the frame comprises at least one top flange extending from an end panel of the frame and wherein the at least one lamp holder clip comprises a recess that receives at least a portion of the at least one top flange to mount the lamp holder clip on the frame.

9. A surface mounted lighting fixture comprising an upper surface for positioning adjacent a ceiling:

a. a frame comprising side panels and end panels; and b. a troffer channel comprising a top wall and side walls extending downwardly at an angle from the top wall, wherein the troffer channel is received in the frame so that the frame extends around a periphery of the troffer channel, wherein the top wall of the troffer channel defines the upper surface of the lighting fixture and wherein the lighting fixture is adapted to be mounted to the ceiling via the top wall of the troffer channel, further comprising a lamp holder bracket supported in the lighting fixture by at least one lamp holder clip mounted on the frame.

10. The lighting fixture of claim 9, wherein the at least one lamp holder clip comprises a resilient tongue and wherein the lamp holder bracket is supported in the lighting fixture at least partially by engagement with the resilient tongue of the lamp holder clip.

11. A method of installing a lighting fixture comprising an upper surface for positioning adjacent a ceiling, the method comprising:

a. providing the lighting fixture comprising:

i. a frame comprising side panels, end panels, and at least one top flange extending from a side panel; and ii. a troffer channel comprising a top wall defining the upper surface of the lighting fixture and side walls extending downwardly at an angle from the top wall, wherein the troffer channel is received in the frame so that the frame extends around a periphery of the troffer channel;

b. securing an installation bracket to the ceiling;

c. mounting the lighting fixture on the installation bracket; and d. mounting the lighting fixture to the ceiling via the top wall of the troffer channel.

12. The method of claim 11, wherein the installation bracket comprises at least one arm, wherein the at least one top flange of the frame comprise at least one slot, and wherein mounting the lighting fixture on the installation bracket comprises positioning the at least one arm of the installation bracket into the at least one slot.

13. The method of claim 11, wherein the installation bracket comprises at least one wing and wherein mounting the lighting fixture on the installation bracket comprises positioning the at least one wing under the at least one top flange.

14. The method of claim 11, wherein the installation bracket further comprises means for aligning the lighting fixture relative to the ceiling.

15. A surface mounted lighting fixture comprising an upper surface for positioning adjacent a ceiling:

a. a frame comprising side panels having a bottom flange and end panels;

b. a troffer channel comprising a top wall and side walls extending downwardly at an angle from the top wall and each having a flange that extends outwardly from the side wall distal the top wall of the troffer channel, wherein the troffer channel is received in the frame so that the frame extends around a periphery of the troffer channel and so that the flanges of the side walls of the troffer channel rest on the bottom flanges of the side panels of the frame;

c. at least one tie bracket extending between the side walls of the troffer channel, wherein at least one end of the tie bracket comprises a flange and wherein a side wall of the troffer channel comprises a tie bracket slot for receiving the flange of the at least one tie bracket;

d. at least one lamp holder clip mounted on the frame; and e. at least one lamp holder bracket supported in the lighting fixture by the at least one lamp holder clip, wherein the top wall of the troffer channel defines the upper surface of the lighting fixture and wherein the lighting fixture is adapted to be mounted to the ceiling via the top wall of the troffer channel.

* * * * *